United States Patent [19]

Perkins

[11] Patent Number: 4,747,701

[45] Date of Patent: May 31, 1988

[54] PLASTIC LINER BAG WITH ELASTIC TOP AND METHOD OF MAKING

[76] Inventor: Stephen Perkins, 525 Justina, Hinsdale, Ill. 60521

[21] Appl. No.: 937,353

[22] Filed: Dec. 3, 1986

[51] Int. Cl.[4] ..... B65D 33/00

[52] U.S. Cl. ..... 383/33; 383/73; 220/404

[58] Field of Search ..... 383/25, 33, 7, 24, 71, 383/73, 118, 49; 220/400, 403, 470, 404; 206/802

[56] References Cited

U.S. PATENT DOCUMENTS

| | | | |
|---|---|---|---|
| 2,631,629 | 3/1953 | Lee | 150/1 |
| 3,148,799 | 9/1964 | Meroney | 220/404 |
| 3,958,393 | 5/1976 | Whitener | 53/37 |
| 4,026,340 | 5/1977 | Sobolik | 150/48 |
| 4,267,928 | 5/1981 | Curry, Jr. | 220/404 |
| 4,509,570 | 4/1985 | Eby et al. | 141/390 |
| 4,611,350 | 9/1986 | Kaczerwaski | 383/71 |

FOREIGN PATENT DOCUMENTS

| | | | |
|---|---|---|---|
| 430256 | 6/1935 | United Kingdom | 220/404 |
| 997675 | 7/1965 | United Kingdom | 220/404 |

*Primary Examiner*—Willis Little

*Attorney, Agent, or Firm*—Willian Brinks Olds Hofer Gilson & Lione Ltd.

[57] ABSTRACT

In general, the product of the present invention is a plastic liner bag which includes an elastic band, integral with the open top of the plastic bag. The edge of the elastic band which is attached to the plastic bag has a circumference in its relaxed state which is approximately equal to the circumference of the open top of the bag. As such, the elastic band does not interfere with the folding or rolling of the plastic liner bags of the present invention. That is, the bag will lie flat on a flat surface. The method of the present invention comprises the steps of forming a plastic bag out of plastic sheet material so as to have an open end and attaching one edge of an elastic band in its relaxed state to the plastic sheet material so as to be integral with the open end of the bag when it is formed.

28 Claims, 2 Drawing Sheets

PLASTIC LINER BAG WITH ELASTIC TOP AND METHOD OF MAKING

BACKGROUND OF THE INVENTION

The present invention relates to plastic bags which are used as liners for waste receptacles and the like. More particularly it relates to such plastic liner bags which include an integral feature to retain the liner in place within the receptacle.

The use of appropriately sized plastic bags as waste receptacle liners has become a common practice in recent years. Because of sanitary and economic consideration, the practice of using plastic bags to line waste receptacles has become standard in most institutional and commercial settings. In addition, plastic bags are also used to line receptacles for soiled laundry and other materials which are collected in a like receptacle.

The plastic liner bags serve at least two important functions. First, the liner prevents the waste or other material from contacting the receptacle, thus avoiding the necessity of cleaning the receptacle. Second, the receptacle can be emptied in an easy fashion by simply pulling the liner full of waste or other material out of the receptacle. This is not only a simpler task for the user emptying the receptacle, but is also more sanitary as it allows the user to better avoid contact with the waste or other material.

A common problem which has hindered the use of plastic bags as waste receptacle liners has been the tendency of the bags have to slide down within the receptacle. That is, even though the top of the bag is folded over the sides of the receptacle, as waste material is placed in the receptacle, the sides of the bag tend to be pulled down. As a result, the bag ends up in a heap at the bottom of the receptacle and thus fails to provide either of the two functions mentioned above.

Several attempts have been made to solve this problem. For example, some bags are designed to be much taller than the receptacle so that more bag can be folded over the top. However, although this may help, it cannot insure that the bag will not slip down. In addition, it is unsightly to have too much bag hanging out of the receptacle.

As another example, waste receptacles have been designed with lids which clamp over the top of the receptacle, thus clamping the top of the bag in place. Naturally, this lid adds expense to the cost of the receptacle and makes installation and removal of the bag more complex and time consuming.

Other examples have been observed. Some bags are maintained in place by gathering part of the top of the bag, drawing it over the rim of the receptacle, and then tying it in a knot. Other bags are maintained in place by tying a string or placing a large rubber band around the top portion of the part which is hanging over the rim of the receptacle. Still other bags are maintained in place by using tape or some other adhesive to attach the top portion of the bag to the receptacle.

In the case of some liner bags, the slight elasticity of the plastic itself will aid in holding the bag in place. That is, some bags will stretch to a small extent so that they are held tightly when folded over the rim of the receptacle. However, the elasticity of the typical liner bag is relatively low and the bags will often tear when pulled too hard. In addition, high density polyethylene, a material which possesses high strength at low cost and would thus be an excellent material for making liner bags, has almost no elasticity.

U.S. Pat. No. 4,509,570 to Eby et al. describes a plastic trash bag which has a hem at its open end. Inside the hem is an elastic loop which is used both to hold the top of the bag to the top of the receptacle as well as to close the bag when it is removed from the receptacle. In particular, the elastic is in a highly stretched state when the bag is open. Although a bag of this design would indeed be better retained in position, certain disadvantages of this design have been noted. First, this design is relatively tedious to manufacture. The elastic loop must be stretched and held in place while the hem is formed in the top of the bag. Although these steps would not be impossible, it would certainly add to the cost of manufacturing such bags. As one might expect, it is important to keep the unit cost of can liner bags to an absolute minimum.

Second, this design, i.e. wherein the elastic is stretched when the bag is open, is relatively difficult to package and dispense. Most can liner bags are efficiently packaged in rolls or in a highly folded condition. Because the elastic is relaxed only when the top of the bag is closed, the bags of this design would not be amenable to packaging in rolls and would not be able to be folded so tightly.

SUMMARY OF THE INVENTION

In general, the product of the present invention is a plastic liner bag which includes an elastic band which is integral with the open top of the plastic bag. The edge of the elastic band which is attached to the plastic bag has a circumference in its relaxed state which is approximately equal to the circumference of the open top of the bag. As such, the elastic band does not interfere with the folding or rolling of the plastic liner bags of the present invention. That is, the bag will lie flat on a flat surface.

The method of the present invention comprises the steps of forming a plastic bag out of plastic sheet material so as to have an open end and attaching one end of an elastic band in its relaxed state to the plastic sheet material so as to be integral with the open end of the bag when it is formed.

In accordance with one preferred method of the present invention, elastic bands in their relaxed state are attached to the two long sides of an elongate plastic sheet. The plastic sheet is then folded lengthwise so as to place one of the elastic bands on top of the other. A series of transverse seals are formed between the two overlying halves of the sheet and the two elastic bands. The seals are spaced along the length of the plastic sheet a distance equal to the desired width of the plastic liner bag. The plastic sheet and elastic bands are then perforated through the transverse seals so that a plurality of plastic liner bags with elastic bands at their open ends can be separated, either by the manufacturer or the user. Most preferably, this manufacturing method is performed on a moving high-speed production line.

In accordance with a second preferred method of the present invention, an elastic band in its relaxed state is laid across a sheet of plastic in a direction transverse to the length of the sheet. The two long edges of the elastic band are adhered to the sheet and then the sheet is folded lengthwise. The overlying halves of the sheet are sealed lengthwise along their ends opposite the fold. Two additional seals between the two halves of the plastic sheet are formed transverse to the length of the folded sheet on opposite sides of the elastic band and at a distance from the elastic band which is equal to the desired length of each plastic liner bag . The elastic and the plastic sheet below it are perforated in the direction transverse to the length of the sheet so that two plastic liner bags with elastic bands at their open ends can be separated. Likewise, this method is most preferably performed on a moving production line, whereby several elastic bands are attached to the plastic sheet and wherein the sheet is also perforated through the transverse seals between the plastic sheet so that the bags can be separated at the midpoint between elastic bands.

As an alternative to both of the above-described methods, rather than folding a single plastic sheet, two sheets are brought together and sealed where the lengthwise fold would have otherwise been.

The present invention thus provides a liner bag which is adapted to be well retained within the receptacle. The liner bag of the present invention is also adapted for economical production and packaging. In addition, the present invention makes it practical to use materials, such as high density polyethylene, which have very low elasticity.

BRIEF DESCRIPTION OF THE DRAWINGS

The present invention will be more clearly understood from the following detailed description of the specific embodiments, read in conjunction with the accompanying drawings, wherein.

DETAILED DESCRIPTION

Figure 1:
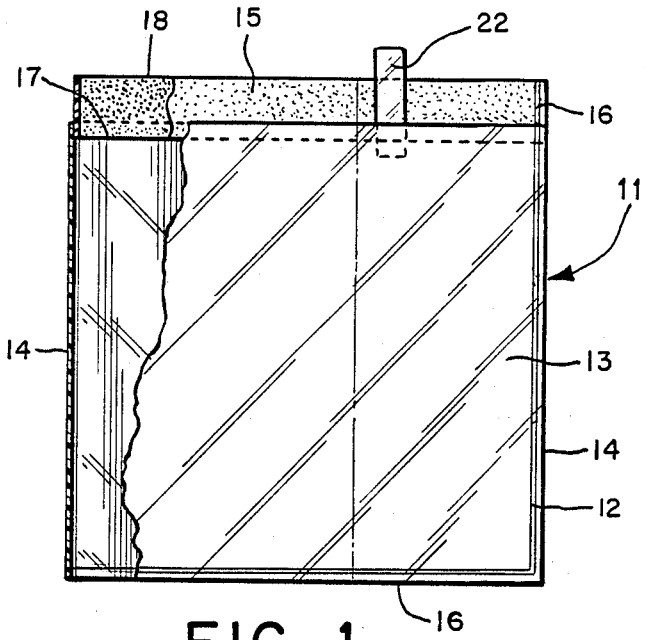
FIG. 1 is a is a side view of the preferred embodiment for the plastic liner bag of the present invention.
Figure 2:
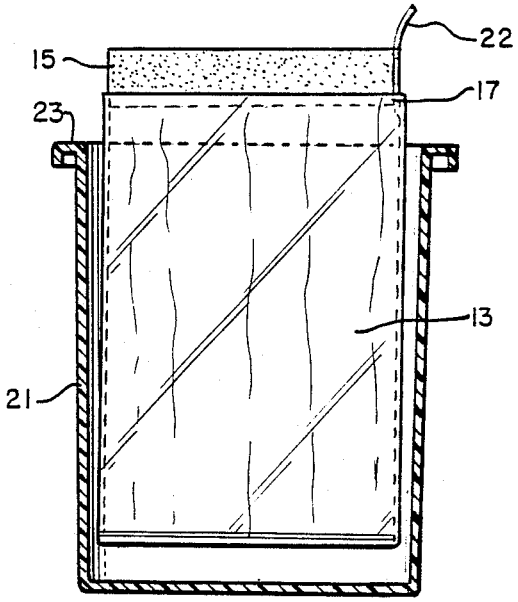
FIG. 2 is a sectional view of a waste receptacle with the plastic liner bag of FIG. 1 placed therein.

Referring to the drawings, FIG. 1 shows a preferred embodiment of the present invention, i.e. a liner bag 11 suitable to be used in a receptacle. The plastic bag 13 is of standard construction. In particular, the bag 13 is made from a film of a thermoplastic material. A polyethylene film is used in the preferred embodiment while a wide variety of other thermoplastic films, such as ethylene/polyvinyl acetate copolymers, may be used in alternative embodiments. Typically, cost and strength will be the most important factors in selecting the particular thermoplastic film. A high density polyethylene is most preferred because of its high strength and low cost.

The thickness of the film will vary depending on the particular thermoplastic material selected and the durability required by the specific application. The film used in the bag will preferably be between about 0.0005" and and about 0.0015" thick. For use in the typical kitchen trash can liner, the thickness is generally about 0.0015" thick.

The plastic bag 13 is preferably rectangular in shape. This shape is preferred because of the simplicity of manufacturing such a bag together with the fact that this shape is compatible with most waste or other receptacles. However, other shapes, such as triangular or trapezoidal are possible if needed to be compatible with an odd-shaped receptacle. Also, it is well known in the art to make bags with pleats and other features to facilitate a better fit within the receptacle.

The plastic bag 13 generally comprises a front and a back sheet which are sealed together in some fashion. Typically, a heat seal 12 is formed about the side edges 14 and between the bottom edges 16. Alternatively, the bottom of the bag can be closed by forming the bag from a single sheet of film which is folded at the bottom and sealed on the sides.

The size of the plastic bag 13 will depend on the size of the receptacle with which it will be used. Preferably, the liner bag will open to a volume slightly larger than that of the receptacle. The most common size for home use is the 13 gallon size. This volume is accomplished by having a bag which is 24 inches tall and 12 inches across.

According to the present invention, The liner bag 11 also comprises an elastic portion 15. An important feature of the elastic portion 15 is that the edge 17 which is attached to the plastic bag 13 will have a circumference in its relaxed state which is approximately equal to that of the top of the plastic bag 13. Thus, the liner bag 11 can be fabricated without stretching the elastic portion 15 during application to the bag 13. This is important in reducing production costs. In addition, because the elastic is in a relaxed state, the liner bag 11 with the elastic portion 15 attached is able to lay flat. This is an important advantage in that the bag can be folded or rolled without added difficulty. Also, the liner bag can be dispensed more easily.

Preferably, the elastic portion 15 is in the form of a rectangular band sealed to the top of the bag 13. In other words, it is preferred that the top, unattached edge 18 of the band 15 have a circumference approximately equal to the circumference of the bottom attached edge 17 which circumference is in turn approximately equal to the circumference of the open top of the bag 13. As will be described below, the band will likely be made from two halves which are sealed at their ends with seals 16 which are colinear with the seals 12 for the sides 14 of the bag 13. Thus, for reasons of simplicity, it is preferred for the top and bottom circumference of the elastic portion to be approximately equal.

In an alternative embodiment, the elastic band 15 is configured so that the top edge 18 has a circumference which is smaller than the circumference of the attached edge 17. Such an embodiment is depicted in FIG. 1 *a*. This embodiment may be desirable for its increased capacity to retain the liner bag with the receptacle. In particular, because the top edge 18 has a smaller circumference, the elastic is required to stretch further when it is folded over the rim of the receptacle. As a result, the elastic band will exert more force to hold the liner bag in place.

In either embodiment, the elastic band 15 is preferably made from a film of an elastic material. At present, a polyurethane film is most preferred. Other elastic materials, such as latex, can also be used. Again, because of the overall motivation to keep the cost of the bag to a minimum, the polyurethane film is currently preferred because of its low cost and ease of fabrication.

The thickness of the elastic film used will depend on the particular elastic material selected. When using polyurethane film the thickness is preferably about 0.001 inches thick. Such a film can be obtained from a number of sources. For example, the film can be obtained from DEERFIELD URETHANE, INC. of Deerfield Massachussetts under the designation "DUREFLEX TM PT6100S."

The width of the elastic band will also vary depending on the particular elastic material selected as well as on the size of liner bag with which it is used. Typically, the elastic band should be wider when used with larger bags. For example, the elastic band on a 4 gallon bag is preferably about 2 inches wide, the elastic band on an 8 gallon bag is preferably about 3 inches wide, the elastic band on a 13 gallon bag is preferably about 4 inches wide, the elastic band on a 30 gallon bag is preferably about 5 inches wide, and the elastic band on a 45 gallon bag is preferably about 6 inches wide.

The elastic portion 15 can be attached to the plastic bag 13 in various ways. It is important that at least a portion of the elastic band is unattached to the bag. This is required in order for the elastic band to be permitted to stretch over the rim of the receptacle independently of the plastic bag 13. Most preferably, the elastic portion is attached by employing a fabrication process wherein the thermoplastic material and the elastic material are simultaneously extruded through a common die to thereby produce a thermoplastic sheet with an elastic band integrally attached thereto.

Alternatively, a preexisting elastic film can be attached to a preexisting thermoplastic film by forming a seal therebetween. If the properties of the two materials permit, a heat seal is preferred. Alternatively, the two films can be sealed with an adhesive.

Most preferably, the bag will also include a tab 22 which is affixed to the elastic band 15 near one of its corners. It has been found that such a tab makes it even easier to install and remove the liner bag 11 from the receptacle. That is, the tab 22 facilitates pulling the final corner of the elastic band 15 over the rim of the receptacle. Naturally, the tab 22 should be of sufficient size for gripping by the consumer. In addition, it may be preferable to make the tab of a bright color so that it is easy for the consumer to spot. It should be noted though, that such a tab is not necessary and factors such as cost may dictate its absence.

Figure 5:
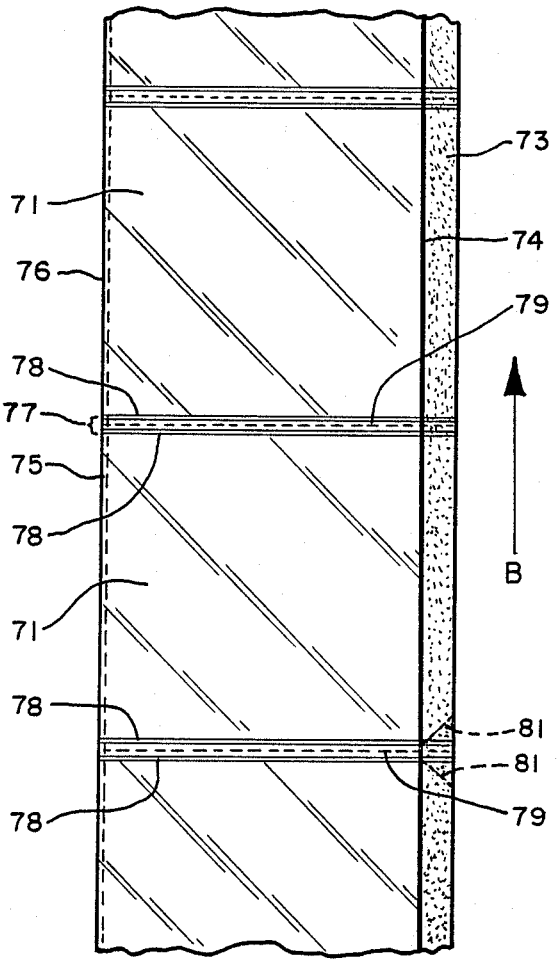
FIG. 5 is a top view of a set of bags showing the placement of the plastic, elastic, seals, and perforations used in a preferred method of making the plastic liner bag.

FIG. 5 illustrates a preferred method of making liner bags according to the present invention. This method is adapted to be carried out on a high-speed production line similar, with noted exceptions, to those presently used for making liner bags. The types of machinery needed to accomplish are well known in the art. The machine direction is indicated by arrow B.

In accordance with this method, two elastic bands 73 (only one shown) in their relaxed state are attached to the two long sides of an elongate plastic sheet 71. Most preferably, these bands 73 are attached by coextruding the material for the bag and for the elastic portion through a common die. Alternatively, the bands can be formed separately and then joined by a heat, adhesive, or other type of seal at seam 74.

The plastic sheet is then folded lengthwise so as to place one of the elastic bands on top of the other. The fold 75 will form the bottom of the liner bags.

Alternatively, rather than folding a single sheet of plastic, two sheets of plastic, each with an elastic band attached to one of their long edged, can be brought together and sealed along their edges opposite the edge with the elastic attached. Thereafter, the method could proceed as described below.

Transverse seals 77 are formed between the two overlying halves of the sheet and the two elastic bands. Each seal 77 can comprise either single seam or, as shown here, a pair of seams 78.

A series of perforations 79 will be made in the sheets and the elastic. If each seal consists of a pair of seams, the perforations 79 will pass between the two seams in each pair. Alternatively, the seals can be made of a single seam wide enough for the perforation to pass through while leaving the sheet sealed together on both sides of the perforation.

The seals 77 and the perforations 79 are spaced along the length of the plastic sheet a distance equal to the desired width of the plastic liner bag. When the plastic sheet and elastic bands are separated at the perforations through the transverse seals, a plurality of plastic liner bags with elastic bands at their open ends. Preferably, the perforations 79 are complete and the separation is thus performed in the production line after which the bags are folded and packaged. Alternatively, the perforations are only made partial in the production line and the bags are separated by the consumer. Typically, such partially perforated bags would be packaged and sold in a roll.

Figure 1A:
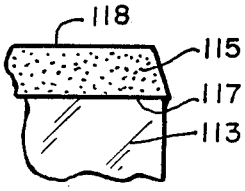
FIG. 1*a* is a partial side view of an alternative embodiment of the present invention.
Figure 3:
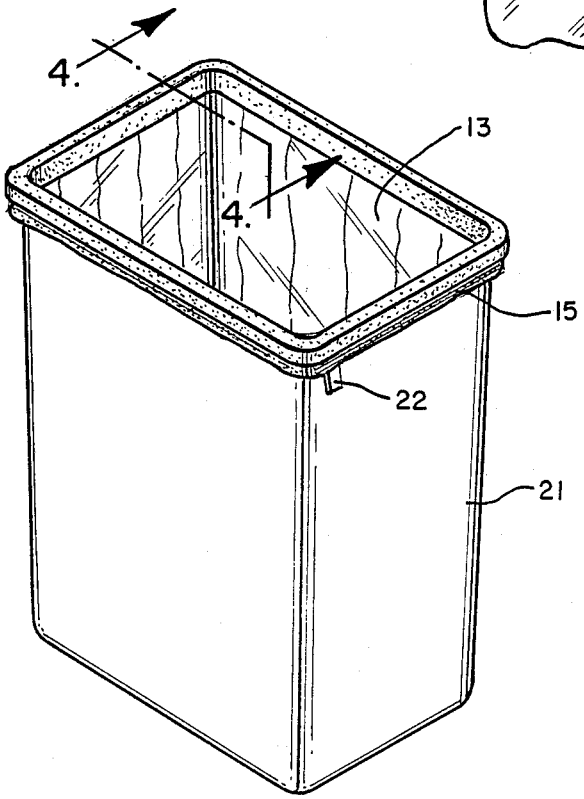
FIG. 3 is a is a perspective view of the plastic liner bag of FIG. 1 after it has been inserted and after the elastic portion has been pulled over the rim of the receptacle.
Figure 4:
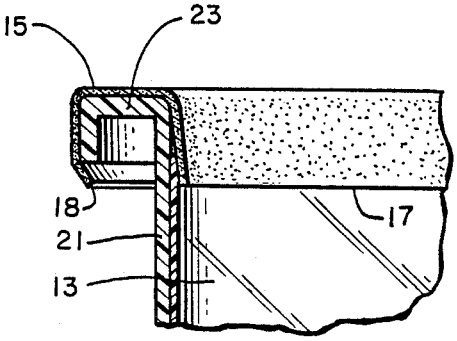
FIG. 4 is a partial sectional view taken along line 4—4 of FIG. 3

The method shown here in FIG. 5 can be modified to produce bags such as that shown in FIG. 1*a*, i.e. with a smaller top circumference on the elastic band. This is accomplished by changing the seams 78 so that they flair away from each other as they pass through the elastic band 73. This flairing is shown by the dotted lines 81. In this way, liner bags are created with tapered elastic bands.

Figure 6:
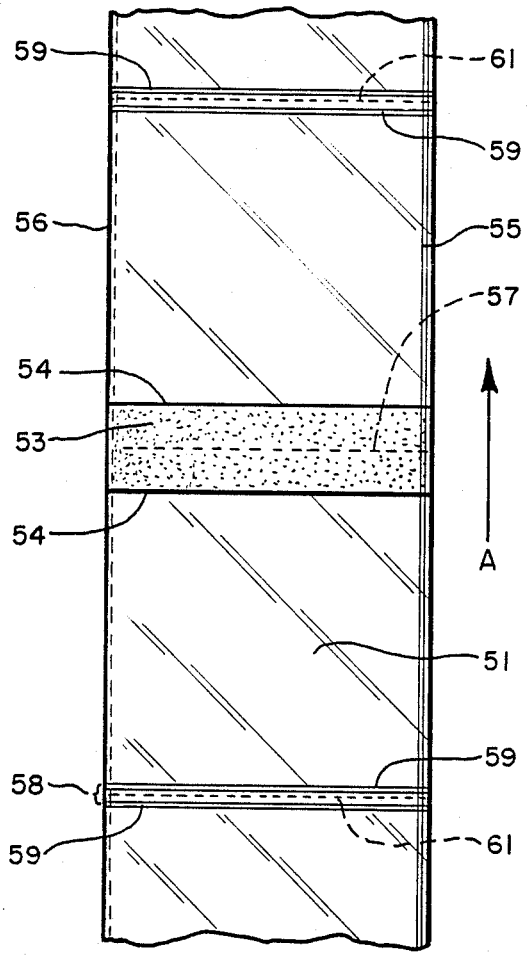
FIG. 6 is a top view similar to FIG. 5 illustrating a second preferred method of making the plastic liner bag.

FIG. 6 illustrates another preferred method of making a liner bag according to the present invention. This method is likewise adapted for use with a high speed production line. The machine direction is indicated by arrow A.

In accordance with this method, an elastic band 53 in its relaxed state is laid across an elongated sheet of plastic 51 in a direction transverse to the length of the sheet. The two long edges 54 of the elastic band are adhered to the sheet and then the sheet is folded lengthwise to create the fold 56. This fold 56 will ultimately form one side of the liner bag.

As an alternative to folding a single plastic sheet, two sheets which have each had elastic strips laid transversely across them can be brought together and sealed along both sides.

Referring again to the embodiment depicted in FIG. 6, the overlying halves of the sheet are sealed lengthwise with a seal 55 along their sides opposite the fold. The seal 55 also passes through the elastic band 53. A seal 58 between the two halves of the plastic sheet is formed transverse to the length of the folded sheet on opposite sides of the elastic band and at a distance from the elastic band which is equal to the desired length of each plastic liner bag. As with the embodiment shown in FIG. 5, this seal can comprise either a single seam or a pair of seams 59. A perforation 61 is made through the seal 58. Likewise a perforation 57 is made through the center of the elastic band and through the folded sheet 51. As with the embodiment shown in FIG. 5, these perforations can be either partial or complete. If partial, the bags are typically packaged in a roll and the final perforation is made by the consumer. If the perforation is complete, the bags are typically folded for packaging.

It is thus shown that a plastic liner bag has been provided which has increased ability to be retained within the receptacle. Certainly, modifications which are within the ordinary skill in the art to make are considered to lie within the scope of the invention as defined by the following claims.

I claim:

1. A generally rectangular plastic liner bag for a receptacle which comprises a generally rectangular plastic bag having an open top with a circumference; and an elastic head having an edge attaced to the platic bag and an edge which is not attached to the plastic bag, said attached edge having a circumference when in a relaxed state which is substantially equal to the circumference of said open top whereby the circumference of the open top is not reduced by the elastic band in a relaxed state, and whereby said plastic bag with said elastic band will lay substantially flat when placed on a flat surface.

2. The liner bag of claim 1 wherein the elastic band comprises a band of elastic film.

3. The liner bag of claim 2 wherein the band of elastic film is between about 2 and about 6 inches in width.

4. The liner bag of claim 1 wherein the circumference of the unattached edge is smaller than circumference of the attached edge.

5. The liner bag of claim 1 further comprising a tab means extending beyond the elastic band.

6. A plastic liner bag for a receptacle which comprises:

a first generally rectangular sheet of a thermoplastic film having two side edges, a bottom edge and a top edge;

a second generally rectangular sheet of a thermoplastic film having two side edges, a bottom edge and a top edge, which second sheet is sealed to the first sheet about the bottom and two side edges to thereby create a liner bag with an open end comprised of the top edge of the first and second sheets;

a first strip of an elastic film having two side edges and two end edges and a length in its relaxed state approximately equal to the length of the top edge of the first sheet, which first strip is sealed about one of its side edges to the top edge of the first sheet;

a second strip of an elastic film having two side edges and two end edges and a length in its relaxed state approximately equal to the length of the top edge of the second sheet, which second strip is sealed about one of its side edges to the top edge of the second sheet, and which second strip is sealed to the first strip about both of its end edges to thereby form a relaxed elastic band integral with the open end of the liner bag.

7. The liner bag of claim 6 wherein the elastic band is between about 2 and about 6 inches in width.

8. The liner bag of claim 6 wherein the elastic band extends above the open top of the plastic bag.

9. The liner bag of claim 6 further comprising a tab means extending beyond the elastic portion.

10. A plastic liner bag for a receptacle which comprises:

a generally rectangular sheet of a thermoplastic film having two long side edges, and first and second short side edges, wherein said sheet is folded so that the first and second short side edges are caused to overlay, and wherein seals are formed along the two long side edges to thereby produce a liner bag with an open top comprising the first and second short side edges;

a first strip of an elastic film having two side edges and two end edges and a length in its relaxed state approximately equal to the length of the short side edges, which first strip is sealed about one of its side edges to the first short side edge of the sheet;

a second strip of an elastic film having two side edges and two end edges and a length in its relaxed state approximately equal to the length of the short side edges, which second strip is sealed about one of its side edges to the second short side edge of the sheet, and which second strip is sealed to the first strip about both of its end edges to thereby form a relaxed elastic band integral with the open end of the liner bag.

11. The liner bag of claim 10 wherein the elastic band is between about 2 and about 6 inches in width.

12. The liner bag of claim 10 wherein the elastic band extends above the open top of the plastic bag.

13. The liner bag of claim 10 further comprising a tab means extending beyond the elastic portion.

14. A method of forming a plastic liner bag for a receptacle which liner comprises an elastic portion, the method comprising:

forming a plastic bag out of thermoplastic film so as to have an open end; and attaching an edge of an elastic band in its relaxed state to the thermoplastic film so as to be integral with the open end of the bag.

15. The method of claim 14 wherein the elastic band is between about 2 and about 6 inches in width.

16. A method of forming a plurality of plastic liner bags including an elastic portion, which method comprises:

providing an elongate sheet of a thermoplastic film having a first and second long side;

attaching a first strip of an elastic film in its relaxed state to the first long side of the sheet;

attaching a second strip of an elastic film in its relaxed state to the second long side of the sheet;

folding the sheet lengthwise so as to cause the first elastic strip to overlay the second elastic strip, and so as to cause a first half of the sheet to overlay a second half of the sheet;

forming a series of transverse seals between the first and second overlaying halves of the sheet and between the first and second elastic strips, wherein said transverse seals are spaced along the sheet at a distance equal to the desired width of the plastic liner bag to thereby form individual liner bags; and perforating the sheet and the elastic bands through the transverse seals.

17. The method of claim 16 wherein the perforating step is performed so as to cause complete separation of the individual liner bags.

18. The method of claim 16 wherein the perforating step is performed so as to allow the individual liner bags to remain attached while also allowing for easy separation by a user.

19. The method of claim 16 wherein the elastic film is attached to the thermoplastic film by causing the two films to be coextruded.

20. The method of claim 16 wherein the strips are between about 2 and about 6 inches wide.

21. A method of forming a plurality of plastic liner bags including an elastic portion, which method comprises:

providing a first elongate sheet of a thermoplastic film having a first and second long side;

providing a second elongate sheet of a thermoplastic film having a first and second long side;

attaching a first strip of an elastic film in its relaxed stated to the first long side of the first sheet;

attaching a second strip of an elastic film in its relaxed state to the first long side of the second sheet;

forming a seal between the first and second sheets along their second long sides so as to cause the first elastic strip to overlay the second elastic strip, and so as to cause the first sheet to overlay the second sheet;

forming a series of transverse seals between the first and second overlaying sheets and between the first and second elastic strips, wherein said transverse seals are spaced along the sheets at a distance equal to the desired width of the plastic liner bag to thereby form individual liner bags; and perforating the sheets and the elastic bands through the transverse seals.

22. The method of claim 21 wherein the perforating step is performed so as to cause complete separation individual liner bags.

23. The method of claim 21 wherein the perforating step is performed so as to allow the individual liner bags to remain attached while also allowing for easy separation by a user.

24. The method of claim 21 wherein the elastic film is attached to the thermoplastic film by causing the two films to be coextruded.

25. The method of claim 21 wherein the strips are between about 2 and about 6 inches wide.

26. A method of forming a plurality of plastic liner bags including an elastic portion, which method comprises:

providing an elongate sheet of a thermoplastic film having a first and second long side;

attaching a plurality of strips of an elastic film in its relaxed state transversely across the sheet, the strips being spaced along the sheet at a distance approximately twice the desired length of the plastic liner bags;

folding the sheet lengthwise so as to cause a first half of the sheet to overlay a second half of the sheet;

forming a seal between the first and second half of the sheet along the first and second long side;

forming a plurality of transverse seals across the sheet at points midway between adjacent strips;

perforating the sheet through the transverse seals; and perforating the sheet through the strips.

27. The method of claim 26 wherein the two perforating steps are performed so as to cause complete separation of individual liner bags.

28. The method of claim 26 wherein the two perforating steps are performed so as to allow individual liner bags to remain attached while also allowing for easy separation of individual liner bags by a user.

* * * * *

UNITED STATES PATENT AND TRADEMARK OFFICE

CERTIFICATE OF CORRECTION

PATENT NO. : 4,747,701

DATED : May 31, 1988

INVENTOR(S) : Stephen Perkins

It is certified that error appears in the above-identified patent and that said Letters Patent is hereby corrected as shown below:

IN THE CLAIMS

In col. 7, line 15, please delete "head" and substitute therefor --band integral with said open top, said elastic band--.

Signed and Sealed this

Twenty-ninth Day of May, 1990

*Attest:*

HARRY F. MANBECK, JR.

*Attesting Officer*

*Commissioner of Patents and Trademarks*